US006739352B1

(12) United States Patent
Munro

(10) Patent No.: US 6,739,352 B1
(45) Date of Patent: May 25, 2004

(54) SELF-PIERCING RADIATOR DRAIN VALVE

(75) Inventor: Jim F. G. Munro, Sunderland (CA)

(73) Assignee: General Motors of Canada Limited, Oshawa (CA)

( * ) Notice: Subject to any disclaimer, the term of this patent is extended or adjusted under 35 U.S.C. 154(b) by 0 days.

(21) Appl. No.: 10/414,317

(22) Filed: Apr. 15, 2003

(51) Int. Cl.[7] ..... F16K 43/00; B23B 41/08; B23B 41/14

(52) U.S. Cl. ..... 137/318; 137/15.13; 165/71; 222/5; 222/81; 222/541.2; 222/552

(58) Field of Search ..... 137/15.13, 15.14, 137/318; 165/71; 222/5, 81, 83, 83.5, 91, 541.2, 541.8, 552

(56) References Cited

U.S. PATENT DOCUMENTS

| | | | | | |
|---|---|---|---|---|---|
| 2,608,989 | A | * | 9/1952 | McDonald | 137/318 |
| 2,875,777 | A | * | 3/1959 | Lacart | 137/318 |
| 3,038,490 | A | * | 6/1962 | Yocum | 137/318 |
| 3,115,889 | A | * | 12/1963 | Franck et al. | 137/318 |
| 3,252,475 | A | * | 5/1966 | Jones | 137/318 |
| 3,438,656 | A | * | 4/1969 | Fritch | 137/318 |
| 4,449,692 | A | * | 5/1984 | Rhodes | 165/71 |
| 4,559,275 | A | | 12/1985 | Matt et al. | |
| 5,099,879 | A | | 3/1992 | Baird | |
| 5,255,716 | A | | 10/1993 | Wilcox | |
| 5,341,848 | A | | 8/1994 | Laws | |
| 5,364,069 | A | * | 11/1994 | Minner et al. | 251/144 |
| 5,392,815 | A | | 2/1995 | Stuart | |
| 5,596,152 | A | | 1/1997 | Bergervoet et al. | |
| 5,762,107 | A | | 6/1998 | Laws | |
| 6,145,544 | A | | 11/2000 | Dutertre et al. | |
| 6,619,380 | B1 | * | 9/2003 | Hartman et al. | 165/71 |
| 2003/0136445 | A1 | * | 7/2003 | Sichler et al. | 137/318 |

FOREIGN PATENT DOCUMENTS

| | | |
|---|---|---|
| GB | 2256460 A | 12/1992 |
| JP | 07035091 | 2/1995 |
| WO | WO 98/17918 | 4/1998 |

* cited by examiner

*Primary Examiner*—George L. Walton
(74) *Attorney, Agent, or Firm*—Laura C. Hargitt

(57) ABSTRACT

A self-piercing radiator drain valve which is implemented in a radiator requiring the coolant therein to be drained, particularly a radiator having no integrated drain valve. A radiator foot has a blind bore. A self-piercing valve body including a piercing tip and a resilient seal is threadingly driven into the blind bore to cause the piercing tip to penetrate the bore end wall and enter into a coolant reservoir tank, thereby providing a valve orifice for draining the tank. The seal provides coolant tight sealing with respect to the valve orifice for the remaining life of the radiator. At any time in the future, coolant draining and refilling can again be performed by unthreading and then rethreading the self-piercing valve with respect to the blind bore, as recounted.

9 Claims, 2 Drawing Sheets

SELF-PIERCING RADIATOR DRAIN VALVE

TECHNICAL FIELD

The present invention relates to automotive radiators, and more particularly to a self-piercing radiator drain valve which is implemented in a radiator, particularly a radiator having no integrated drain valve.

BACKGROUND OF THE INVENTION

Motor vehicles having internal combustion engines generally rely upon a radiator for cooling of the engine. This is accomplished by a coolant liquid circulating through passages in the engine also circulating through the radiator. The radiator has at least one reservoir tank and a fluidically interfaced heat exchanger composed of a serpentine tube interfaced with fins. As the hot coolant from the engine passes through the tube, heat of the coolant is given up to the atmosphere so that at the other end of the tube a cooler coolant is returned to the engine.

One aspect of maintenance is the ability to drain coolant from the radiator. Until recent advances in coolant chemistry, former formulations of coolant required its periodic changing. Accordingly, radiators have been conventionally equipped with an integrated drain valve composed of a hand operated stop cock located at the bottom of the reservoir tank. Not only does this drain valve involve an inherent cost, the placement involves design-required packaging so that service personnel can gain access thereto.

However, modern coolants generally do not need changing except at extremely high mileage. Added to this has been the development of improved seals and joints, and decreased need to lower coolant level due to servicing for other reasons, for example because of improved powertrain quality and durability.

Therefore, since modern vehicles have the ability to go for an extremely long time (or even never in the course of its life cycle) without need of the coolant drainage, the need for an integrated drain valve has become lessened. This creates the possibility that radiators could be manufactured and installed without the cost and design involvement associated with an integrated drain valve. The problem is, however, how to drain such a radiator if the need should one day arise.

Accordingly, it would be desirable if a radiator produced without an integral drain valve could somehow be retrofitted to have a drain valve later in the life cycle of the motor vehicle.

SUMMARY OF THE INVENTION

The present invention is a self-piercing radiator drain valve which is implemented in a radiator requiring the coolant therein to be drained, particularly a radiator having no integrated drain valve.

A radiator has feet (or sprues) which serve as lower attachment points for the radiator in a motor vehicle. Each foot has a blind bore, wherein the blind of the bore is defined by a bore end wall. For least one of the feet, the bore wall is situated vertically beneath an adjoining reservoir tank of the radiator. This foot will provide a valve passage of the self-piercing radiator drain valve according to the implementation methodology of the present invention.

A self-piercing valve body is provided which includes a drive head at one end of a shaft, a threaded section of the shaft adjacent the drive head, a piercing tip attached to the shaft opposite the drive head, and a resilient seal adjacent the piercing tip. The self-piercing valve body is sized to cooperate with the aforementioned foot to collectively provide the self-piercing radiator drain valve according to the present invention.

In operation, the self-piercing valve body is placed, piercing tip first, into a selected blind bore located underneath an adjoining reservoir tank and threadably driven further thereinto via the drive head. The threading causes the piercing tip to penetrate the bore end wall, thereby resulting in the blind bore becoming the valve passage of the self-piercing radiator drain valve. Thereafter, the self-piercing valve body is unthreaded, whereupon a valve orifice, which has been formed in the bore end wall by the piercing, permits coolant to drain out of the radiator reservoir tank through the valve passage. When it comes time to refill the radiator with coolant, the self-piercing valve body is again threaded into the blind bore, whereupon the seal provides coolant tight sealing with respect to the valve orifice for the remaining life of the radiator. At any time in the future, coolant draining and refilling can again be performed by unthreading and then rethreading the self-piercing valve with respect to the blind bore, as recounted.

Accordingly, it is an object of the present invention to provide a self-piercing radiator drain valve for automotive radiators, particularly radiators having no integral drain valve, which permits coolant drainage and subsequent coolant re-fill.

DESCRIPTION OF THE PREFERRED EMBODIMENT

Figure 1:
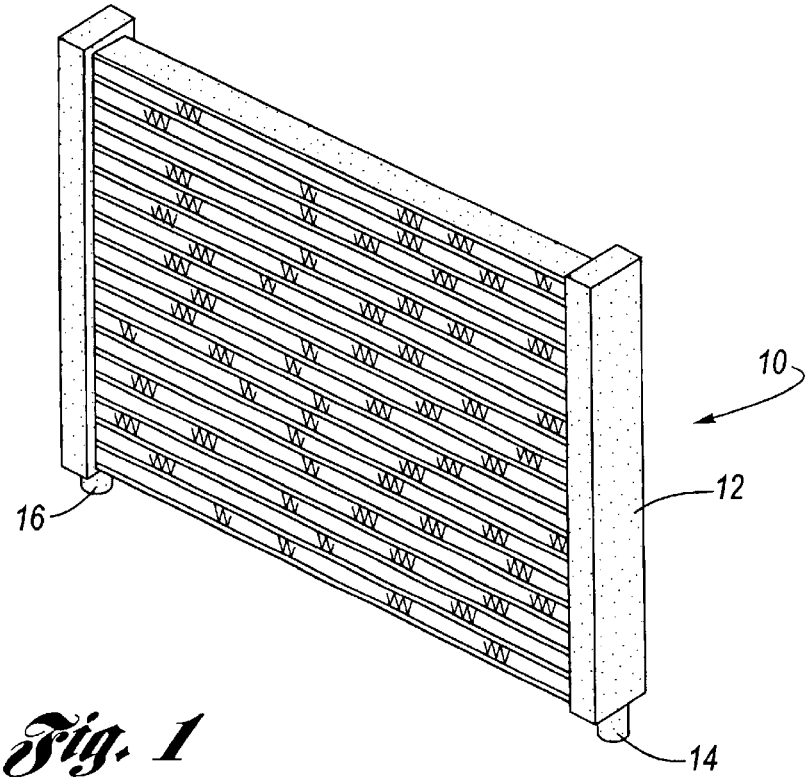
FIG. 1 is a perspective view of an automotive radiator having a plurality of feet.
Figure 2:
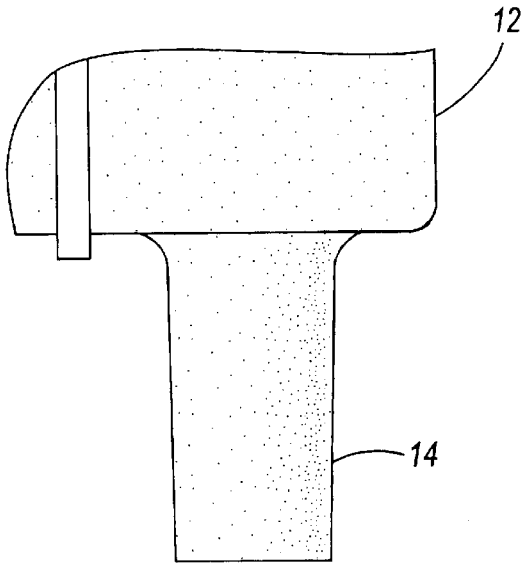
FIG. 2 is a detail side view of a foot of the radiator of FIG. 1.
Figure 3:
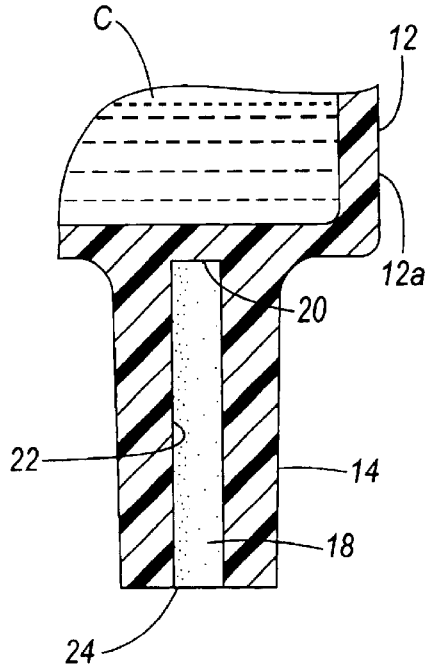
FIG. 3 is a sectional view of the foot of FIG. 2, showing the blind bore therewithin.

Referring now to the Drawing, FIGS. 1 through 3 depict an example of an automotive radiator 10 having at least one coolant reservoir tank 12 and at least two feet 14, 16, wherein at least one of the feet (for example foot 14 which shown in detail at FIG. 2) is located beneath an adjoining coolant reservoir tank. As shown at FIG. 3, the foot 14 has a blind bore 18, the blind end of which being defined by a bore end wall 20. The bore end wall 20 serves as a portion of the tank wall 12*a* for the coolant reservoir tank 12. The blind bore 18 further has a cylindrically shaped bore side wall 22 defining a bore opening 24. The foot 14 may be composed of plastic or another suitable material. The automotive radiator 10 may be manufactured absent an integral drain valve. The bore side wall 22 adjacent the opening 24 may or may not be provided with threads (see 26 at FIG. 6), as will be made clear momentarily.

Figure 4:
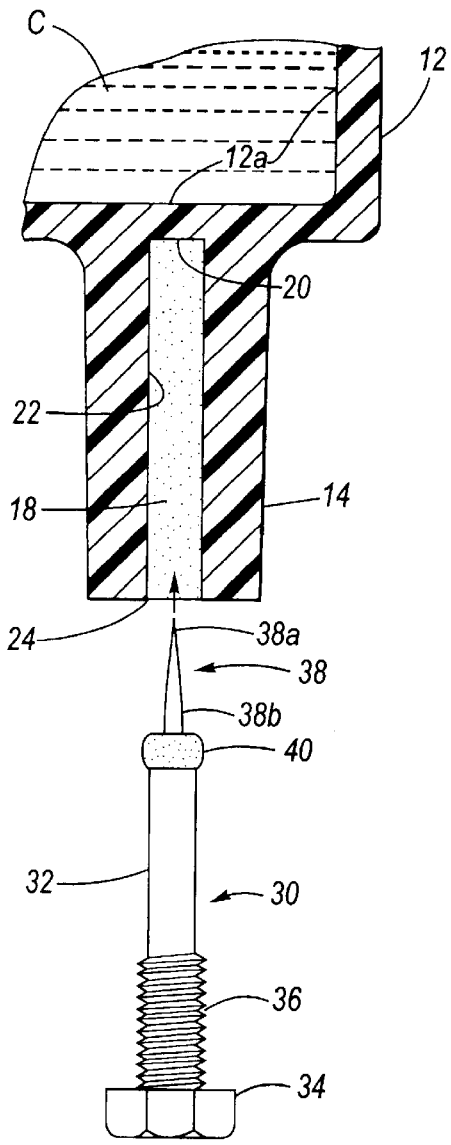
FIG. 4 is a partly sectional, exploded view showing a self-piercing valve body according to the present invention about to be threadably engaged with the blind bore of the foot of FIGS. 2 and 3.

Turning attention now to the lower portion of FIG. 4, a self-piercing valve body 30 is shown which includes a shaft 32, a drive head 34 at one end of a shaft, a threaded section 36 of the shaft adjacent the drive head, a piercing tip 38 attached to the end of the shaft opposite the drive head, and a resilient seal 40 located at the end of the shaft in circumscribing relation with respect to the piercing tip.

All the components, with the exception of the annular seal, are composed of a rigid, durable material, such as for example brass, wherein the piercing tip 38, if separately connected to the shaft, may be composed of a stronger material, such as for example stainless steel. The resilient seal may be composed of any durable, resilient, sealing material, such as for example a polymer or rubber. The annular seal 40 may be pressed through the piercing tip and then adhesively attached to the abutting end of the shaft 32. The drive head 34 my have any mechanical tool drive interface, as for example an external hex (as shown) for being drivingly engaged by a wrench, a slot for being drivingly engaged by a screw driver, an internal hex for being drivingly engaged by a hex (Allen) wrench, etc. The piercing tip 38 includes a point 38*a* at the end of a stem 38*b*. The stem 38*b* may be integral with the shaft 32, or may be press-fit or otherwise attached to a mounting hole axially positioned in the shaft.

The self-piercing valve body 30 is sized to cooperate with the foot 14 to mutually provide a self-piercing radiator drain valve 42 (see FIG. 5) collectively composed of the self-piercing valve body 30 and a valve passage 44 formed of the blind bore 18 by operation of the self-piercing valve body. In this regard, the conversion of the blind bore 18 into the valve passage 44 occurs by action of the piercing tip 38 penetrating the bore end wall 20 as the threaded section 36 is threaded with respect to the threads 26 of the blind bore. As mentioned hereinabove, the blind bore 18 may be pre-threaded, threaded post-manufacture when needed by a service technician using a tap when needed, or be threaded by self-tapping threads of the threaded section 36.

Operation will now be described, with reference being directed to FIGS. 4 through 6.

As shown at FIG. 4, a foot 14 is first selected because it dependingly adjoins a coolant reservoir tank 12. A service technician chooses an appropriate self-piercing valve body 30, and then, hand grasping it, inserts the piercing tip 38 into the opening 24. The self-piercing valve body is then hand thrust into the blind bore, wherein the diameter of the shaft 32 is just less than the diameter of the blind bore 18 so as to facilitate sliding of the shaft in the bind bore. Just before the point 38*a* abuts the bore end wall 20, the threaded section 36 either engages already present threads 26 of the blind bore 18, or engages the blind bore at the opening 24 whereat it is about to begin self-tapping threads into the bore side wall 22. The threaded engagement is continued by the technician using a tool, such as a band or powered wrench which mechanically turns the drive head 34.

Continued threading is accompanied by the point 38*a* pressing against, and into, the bore end wall which results eventually in the piercing tip penetrating through the bore end wall. By the time the drive head 34 bottoms against the foot at the opening (as shown at FIG. 5), the stem 38*b* extends through the bore end wall so as to now fully form a valve orifice 46. At this point, the blind bore 18 has been converted into a valve passage 44 for draining of the coolant C.

As the drive head bottomed against the foot, the resilient seal 40 became resiliently compressed between the end of the shaft 32 and the portion of the bore end wall 20*p* that is peripheral to the valve orifice 46. The resulting compliant reshaping of the resilient seal 40 results in it providing compressional sealing with respect to the bore end wall and the bore side wall 22 such as to provide water-tight sealing for the radiator coolant reservoir 12 at the valve passage 44. Proper resilient seal function is assured by the lengths of the self-piercing valve body and the blind bore being matched so that the valve orifice is fully formed and the resilient seal is sealingly compressed by the time the drive head bottoms on the foot. If desired, further sealing assurance can be provided by a sealant being applied to the threaded section prior to threading engagement.

Now, in order to drain coolant C from the radiator, the self-piercing valve body 30 is unthreaded and removed from the valve passage 44 (the former blind bore 18). As shown at FIG. 6, coolant C is now free to flow out the valve orifice 46 until the coolant has drained (entirely or selectively) out through the valve passage.

Figure 5:
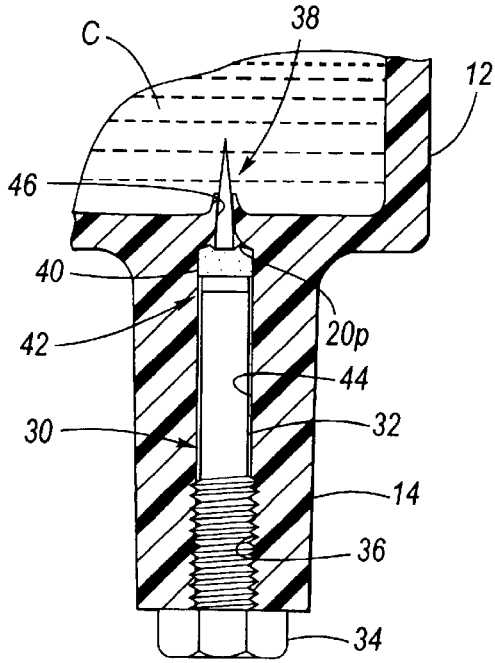
FIG. 5 is a partly sectional view, showing the self-piercing valve body now threadably engaged with the blind bore, wherein the bore end wall has been pierced thereby, converting the blind bore into a valve passage.
Figure 6:
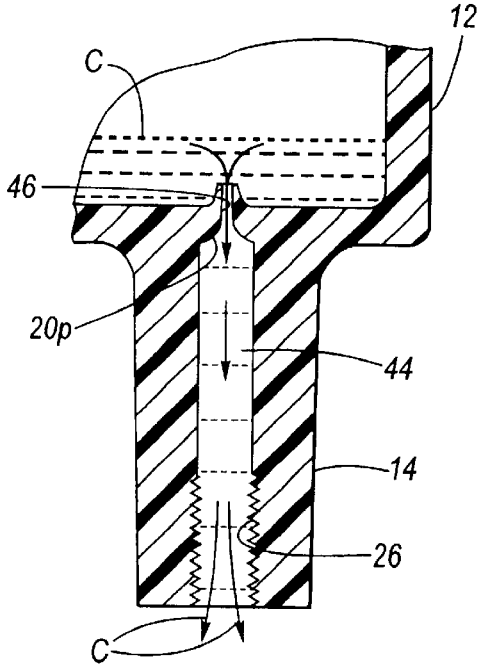
FIG. 6 is a sectional view of the valve passage of FIG. 5, wherein now the self-piercing valve body has been unthreaded therefrom so as to permit coolant drainage to ensue.

When it comes time to refill the radiator with coolant, the self-piercing valve body 30 is first re-threaded into the blind bore, whereby the resilient seal provides once again a tight seal which prevents coolant leakage with respect to the valve orifice (valve passage) for the remaining life of the radiator, as shown at FIG. 5. At any time in the future, coolant draining and refilling can again be performed by unthreading and then rethreading the self-piercing valve with respect to the blind bore, as recounted hereinabove.

Figure 7:
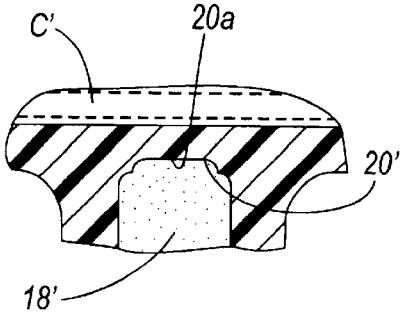
FIG. 7 is a sectional view of the bore wall of a blind bore which has been provided with a reduced thickness to facilitate piercing by the self-piercing valve body according to the present invention.

FIG. 7 depicts a blind bore 18' in which the bore end wall 20' has a locally reduced thickness central area 20*a*. This may be required in the event the material of the radiator wall is hard in relation to the hardness of the piercing tip, or thick, such that, in either case, penetration by the piercing tip is difficult. In such situations, the bore end wall is manufactured with a locally thinned central area 20*a* in anticipation of the possibility of future use of the self-piercing valve body 30.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A self-piercing radiator drain valve, comprising:

a radiator comprising:

a coolant reservoir tank;

a foot connected with said tank, said foot having a blind bore terminating at a intrangible bore end wall defining a portion of bottom wall of said tank; and a self-piercing valve body comprising:

a drive head connected to said first end of said shaft;

a pointed piercing tip connected to said first end of said shaft; and a seal connected to said second end of said shaft in circumscribing relation to said piercing tip;

wherein said self-piercing valve body is threadingly engageable with said blind bore such that in a threadingly engaged state of said self-piercing valve body with respect to said blind bore, said piercing tip pierces through said bore end wall, creating a flow opening therethrough and said seal is in sealing relation with respect to said flow opening when said self-piercing valve body is fully inserted within said bore end blind bore.

2. The self-piercing radiator drain valve of claim 1, wherein said threaded section comprises self-tapping threads which tap threads into said blind bore and thereby provide said threadingly engaged state.

3. The self-piercing radiator drain valve of claim 2, wherein said bore end wall has a thickness which is locally reduced whereat said piercing tip pierces through said blind bore end.

4. The self-piercing radiator drain valve of claim 2, wherein said blind bore has threads which are threadingly engageable with said threaded section to thereby provide said threadingly engaged state.

5. The self-piercing radiator drain valve of claim 4, wherein said bore end wall has a thickness which is locally reduced whereat said piercing tip pierces through said blind bore.

6. A method for providing a radiator drain valve, comprising the steps of:

providing a radiator having a coolant reservoir tank, the tank including a foot connected with said tank, said foot having a blind bore therein terminating at a bore end wall defining a portion of a bottom wall of said tank;

piercing the bore end wall of the tank to provide a valve orifice therein;

selectively sealing said valve orifice by a self-piercing valve member;

wherein when said valve orifice is sealed, coolant in the tank is retained therein, when said self-piercing valve is fully inserted within said bore; and wherein when said valve orifice is unsealed, the coolant drains from the tank, when said self-piercing vale member is movable to various positions within said blind bore.

7. The method of claim 6, wherein said step of piercing comprises a piercing tip threadably engaged with the radiator being threadingly driven with respect to the radiator so as to cause the piercing tip to pierce the tank.

8. The method of claim 7, wherein said step of selectively sealing comprises a seal sealing said valve orifice when the piercing tip is in a pierced relationship with respect to the tank.

9. The method of claim 8, wherein said step of fabricating provides at least one foot connected to the radiator adjacent the tank; and said step of piercing further comprises threadingly driving the piercing tip with respect to the foot so as to cause the piercing tip to pierce the tank.

* * * * *